US005085032A

United States Patent [19]

Facchini Edoardo

[11] Patent Number: 5,085,032

[45] Date of Patent: Feb. 4, 1992

[54] METHOD TO PREPARE A LEADING EDGE OF A PHOTOGRAPHIC FILM FOR FRAMING, A DEVICE EMPLOYING THE METHOD AND PHOTOGRAPHIC FILM THUS PREPARED

[76] Inventor: Facchini Edoardo, Via Molini 61/3, Cordenons (PN), Italy, 33084

[21] Appl. No.: 420,320

[22] Filed: Oct. 12, 1989

[30] Foreign Application Priority Data

Oct. 27, 1988 [IT] Italy ..... 83500 A/88

[51] Int. Cl.[5] ..... B65B 63/00

[52] U.S. Cl. ..... 53/435; 83/13; 83/948; 354/203; 355/75

[58] Field of Search ..... 83/13, 56, 614, 948; 40/152; 53/520, 435; 29/433; 493/944; 352/157, 158; 354/203; 355/75

[56] References Cited

U.S. PATENT DOCUMENTS 4,099,362 7/1978 Dorman ..... 53/520
4,135,343 1/1979 Urban et al. ..... 53/520 X
4,543,771 10/1985 Jensen et al. ..... 53/520
4,665,681 5/1987 Facchini et al. ..... 53/520
4,934,128 6/1990 Savio et al. ..... 53/520

FOREIGN PATENT DOCUMENTS 89102624.7 8/1989 European Pat. Off. .

*Primary Examiner*—Frank T. Yost
*Assistant Examiner*—Kenneth E. Peterson
*Attorney, Agent, or Firm*—Nixon & Vanderhye

[57] ABSTRACT

Method to prepare a leading edge of a photographic film for framing, the leading edge (13) of the photographic film (11) being sheared at an angle (18) to the direction of feed (15) of the film (11) in a frame (12).

Device to frame a photographic film (11) in frames (12), which employs the above method and comprises an assembly able to shear at an angle (18) the leading edge (13) of the photographic film (11).

Photographic film (11) prepared with the above device and comprising a leading edge (13) sheared at an angle (18) to the direction of feed (15) within the frame (12).

2 Claims, 1 Drawing Sheet

METHOD TO PREPARE A LEADING EDGE OF A PHOTOGRAPHIC FILM FOR FRAMING, A DEVICE EMPLOYING THE METHOD AND PHOTOGRAPHIC FILM THUS PREPARED

BACKGROUND OF THE INVENTION

1. Field of the Invention

This invention concerns a method to prepare a leading edge of a photographic film for framing.

2. Discussion of Prior Art

To be more exact, the invention concerns a method suitable to prepare the leading edge of the photographic film so that a photograph can be inserted without any problem in any type of frame normally available on the market.

The invention concerns also a framing device with employs the above method.

The invention concerns also a photographic film prepared with the device which employs the above method.

A plurality of methods and devices employed to frame photographic films are known in the state of the art.

A single photograph can be inserted into the frame and in this case the film is cut outside the frame, or else the film can be inserted into the frame and in this case the photograph is cut inside the frame. This latter case is disclosed , for instance, in Italian patent application No. 83326 A/88 corresponding to U.S. Pat. No. 4,934,128 to Savio et al issued June 19, 1990.

In both cases the problem to be tackled is how to insert the leading edge of the film or photograph between the two half-frames in correspondence with the window of the frame and at the opposite side to that where the film or photograph is inserted.

There is always a ledge at this position and the leading edge of the film or photograph arrives concave or convex.

Various solutions have been provided to deal with this problem, such as the reciprocal opening of the two half-frames at the side where the film or photograph is inserted, or else the partial opening of the half-frames either on the side of insertion or on the opposite side, or a conformation of the edges of the window suitably arranged to facilitate insertion of the leading edge of the film or photograph, or yet other solutions. All of this entails the inclusion of specialized devices in the framing machines or the use of frames which are more complex to construct together with the additional relative costs.

SUMMARY OF THE INVENTION

The present applicant has set himself the objective of obtaining a framing method and framing device and a photographic film or photograph which are suitable for insertion within any frame without any extra cost.

The invention is set forth in the independent claim while the dependent claim describe various features of the invention.

According to the invention the shearing of photographs from the film is carried out at an angle to the direction of feed of the film or photographs within the frame. In this way the leading edge of the film or photograph being fed within the frame arrives at differing times at the edges of the window located at the side opposite to that of insertion.

This means that the insertion between the half-frames takes place initially along a limited segment in the neighbourhood of one of the corners of the window. This insertion of this limited segment causes the flattening of the concavity or convexity of a limited neighbouring segment, which approaches and then comes into contact with the edges of the window and can be readily inserted therebetween.

The method of insertion proceeds in the same way thereafter until the whole of the leading edge of the film or photograph has been inserted between the two half-frames.

A gradual insertion of the above type enables frames and windows of a not specially conformed type to be used in cooperation with normal means suitable for partial opening of the half-frames on the side where the film or photograph is introduced.

These special features of the invention will be shown better in the description that follows.

BRIEF DESCRIPTION OF THE DRAWINGS

The attached drawings, which are given as a non-restrictive example, show the following.

DETAILED DISCUSSION OF PREFERRED EMBODIMENTS

Figure 1A:
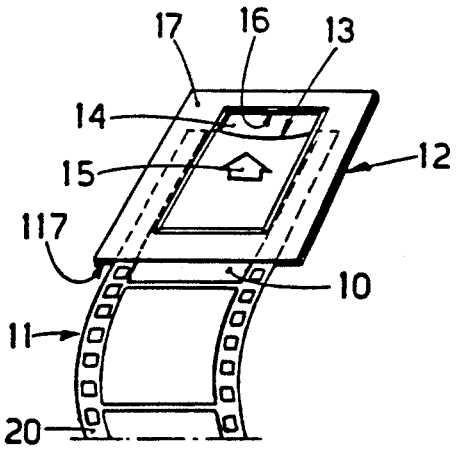
fig.1a (PRIOR ART)
FIGS. 1*a* and 1*b* show the case of insertion of a film in a frame according to the state of the art.
Figure 1B:
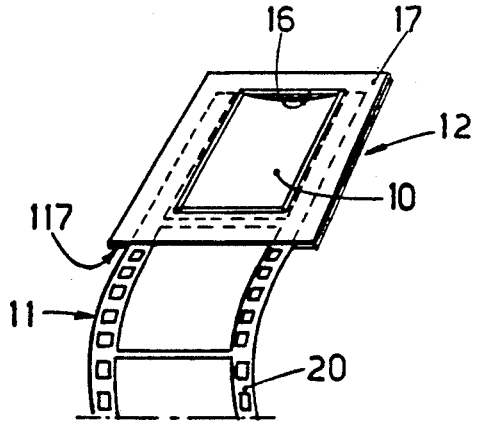
fig.1b (PRIOR ART)

FIGS. 1*a* and 1*b* show the case of insertion of a photograph 10 of a film 11 into a frame 12 according to the state of the art.

The photograph 10 comprises a concave or convex leading edge 13, which while sliding according to the arrow 15 within a window 14 of the frame 12 abuts against a ledge 16 consisting of the thickness of the two half-frames 17–117 coupled together in correspodence with the window 14.

This entails the practical impossibility of completing insertion of the photograph 10 between the two half-frames 17–117.

FIGS. 2*a* to 2*d* show the steps of insertion of a photograph 10 prepared with the method of the invention.

According to the invention a shearing device, which is not shown in the figures, performs on the leading edge 13 of the film 11 a cut 18 at an angle to the direction of feed 15 of the film 11 within the frame 12. The shearing can be either prior to or after the film is inserted within the frame.

This cut 18 at an angle enables the leading edge 13 to approach the ledge 16 of the window 14 gradually.

Figure 2A:
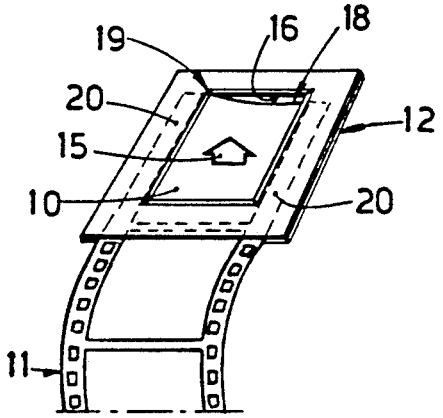
FIGS. 2*a* to 2*d* show the steps of insertion of a film in a frame according to the invention.

The passing of the ledge 16, that is to say, the insertion between the two half-frames 17–117, takes place by starting at one of the corners of the window 14, for instance the corner 19 in FIG. 2*a*.

Figure 2B:
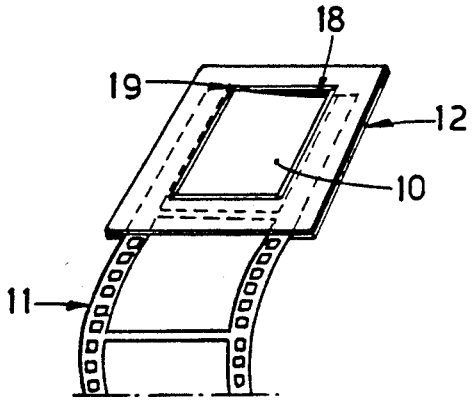

Side edges 20 of the film 11 are always inserted between the half-frames 17–117, and therefore the insertion into the ledge 16 takes place initially along a small segment of the angled cut 18 at the corner 19 (see FIG. 2*b*).

Figure 2C:
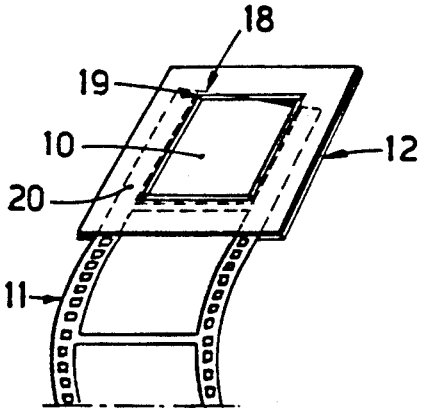
Figure 2D:
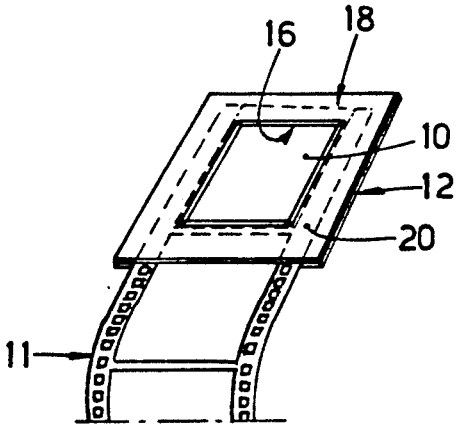

The inserted segment causes flattening of the neighbouring angled segment, which in this way is inserted readily between the two half-frames 17–117 (see FIG. 2*c*).

The process continues in the same way along successive segments until the whole ledge 16 of the window 14 has been passed and the photograph 10 has been fully positioned within the frame 12 as a result.

I claim:

1. A method of mounting photographic film is a slide frame comprising the steps of shearing a leading edge of said film and moving said leading edge of said film in a direction of feed into said slide frame, said shearing being from a side edge of said film to an opposite side edge of said film and being at a non-perpendicular angle to said direction of feed.

2. The method as claimed in claim 1 in which said step of shearing at an angle is carried out outside said slide frame.

* * * * *